United States Patent [19]

Payet

[11] 4,108,598

[45] Aug. 22, 1978

[54] DURABLE PRESS PROCESS

[75] Inventor: George L. Payet, Cincinnati, Ohio

[73] Assignee: The Strike Corporation, Cincinnati, Ohio

[21] Appl. No.: 746,743

[22] Filed: Dec. 2, 1976

[51] Int. Cl.[2] ..... D06M 9/12; D06M 13/12

[52] U.S. Cl. ..... 8/115.7; 8/116.4

[58] Field of Search ..... 8/116.4, 115.7

[56] References Cited

U.S. PATENT DOCUMENTS

| | | | |
|---|---|---|---|
| 2,243,765 | 5/1941 | Morton | 8/116.4 |
| 3,663,974 | 5/1972 | Watanabe et al. | 8/116.4 |
| 3,841,832 | 10/1974 | Swidler et al. | 8/125 |

FOREIGN PATENT DOCUMENTS 980,980 1/1965 United Kingdom.

OTHER PUBLICATIONS

Fujimoto, R. et al., Amer. Dyestuff Reporter, vol. 52, No. 9, pp. 30–37, (1963).

Fenner, T. W. et al., Amer. Dyestuff Reporter, vol. 51, No. 7, pp. 29–33, (1962).

Gruntfest, I. J. et al., Textile Research Journal, vol. 18, No. 11, pp. 643–650, (1948).

Roff, J. Journal of the Textile Institute, vol. 54, pp. T281–T296, (1963).

*Primary Examiner*—Joseph L. Schofer
*Assistant Examiner*—Maria S. Tungol
*Attorney, Agent, or Firm*—Bacon & Thomas

[57] ABSTRACT

Cellulosic fiber-containing fabrics are made wrinkle resistant by a durable press process which comprises treating a cellulosic fiber-containing fabric with aqueous formaldehyde and a catalyst capable of catalyzing the cross-linking reaction between the formaldehyde and cellulose, heat-curing the treated cellulose fiber-containing fabric, preferably having a moisture content of more than 20% by weight, under conditions at which formaldehyde reacts with cellulose in the presence of the catalyst without a substantial loss of formaldehyde before the reaction of the formaldehyde with cellulose to improve the wrinkle resistance of the fabric.

16 Claims, No Drawings

DURABLE PRESS PROCESS

This invention relates to a durable press process for cellulosic fiber-containing fabrics and more particularly to a process which utilizes minimum amounts of formaldehyde and catalysts to impart wrinkle resistance to the cellulosic fiber-containing fabrics.

There have been a great many proposed processes in recent years for treating cellulosic fiber-containing products with formaldehyde to provide durable crosslinking of the cellulose molecules and to thereby impart durable crease resistant and smooth drying characteristics to these products. Such cellulosic fiber-containing fabrics include cloth made of cotton or cotton blends. However, problems have been encountered with the known processes. A simple, reproducible, completely satisfactory low-cost formaldehyde durable press process has not yet been achieved.

It has long been known to treat cellulosic materials with formaldehyde as is evidenced by U.S. Pat. No. 2,243,765. This patent describes a process for treating cellulose with an aqueous solution of formaldehyde containing a small proportion of an acid catalyst under such conditions of time and temperature that the reaction is allowed to approach its equilibrium. It is further stated that in carrying out this process the proportion of the solution of formaldehyde to the cellulose must be at least such that the cellulose is always in a fully swollen state. It is also stated that the time and temperature of the treatment with the solution of formaldehyde and acid catalyst will vary with one another, the time required increasing rapidly as the temperature diminishes. When it is desired, the product may be isolated by washing and drying; preferably at a temperature of about 100° C. The products obtained according to this process are said to show no increase in wet strength and possess a high water imbibition, no increase resistance to creasing and a slight increase affinity to some direct dyes.

In recent years additional methods have been devised for treating cellulosic fiber-containing products in order to impart durable crease retention, wrinkle resistance and smooth drying characteristics to these products. As discussed, formaldehyde has been crosslinked with cellulose materials to produce these products. It is also known to treat cellulose materials with resins or precondensates of the urea-formaldehyde or substituted urea-formaldehyde type to produce a resin treated durable press product. As noted in U.S. Pat. No. 3,841,832, while formaldehyde has made a significant contribution to the cotton finishing art, the result has been far from perfect. For instance, in some cases the formaldehyde crosslinking treatment has tended to lack reproducibility, since control of the formaldehyde crosslinking reaction has been difficult. Moreover, when high curing temperatures were used with an acid or potential acid catalyst, excess reaction and degradation of the cotton often happened which considerably impaired its strength. On the other hand, when attempts were made to achieve reproducibility at temperatures of 50° C or less, much longer reaction or finishing times were usually required, rendering the process economically relatively unattractive. This has been said to be particularly true when sulfur dioxide was used as a catalyst in the previously known processes such as that described in U.S. Pat. No. 3,663,974 or the corresponding British Pat. No. 980,980.

In order to overcome these disadvantages the aforesaid U.S. Pat. No. 3,841,832 described a process wherein the cotton or other cellulose containing fabric such as a cotton polyester blend is impregnated with a liquid solution containing about 2 to 40% formaldehyde in water or similar liquid solvent to give a wet pickup of between about 50 and 110% based on the dry cotton weight. The fabric is then conditioned or dried, preferably to a moisture content of between about 10 or 12 and 18%, passed through or placed in an atmosphere containing sulfur dioxide gas, maintained in the presence of the sulfur dioxide under control moisture and temperature conditions until the proper amount of formaldehyde is durably deposited or fixed in the fabric. It is clear that this process requires the precise control of the moisture content of the fabric to be less than 20% by weight. Despite all of the efforts and extensive research in the field, and particularly in view of the commercial acceptability of durable press products, a simple, low-cost durable press process is still needed. It is particularly important to decrease the chemical cost and energy consumption of the durable press process.

Fundamental to the present invention is the discovery that in durable press processes using formaldehyde in whatever form, the formaldehyde comes off of the fabric during the heating thereby preventing proper crosslinking of the fabric. That is, if some of the formaldehyde is lost during the drying it will obviously not be available for the crosslinking reaction. This occurs whether or not the formaldehyde is applied from an aqueous solution or is added in the vapor phase since it is the hydrated form of formaldehyde which is the crosslinker.

In those durable press processes utilizing a vapor phase it is believed that the function of the vapor processing is to uniformly deposit formaldehyde and paraformaldehyde on the fabric via the gas route. The fabric being wet converts the paraformaldehyde to aqueous formaldehyde and since there is an excess of paraformaldehyde present, there should be a plentiful source of aqueous formaldehyde for the crosslinking reaction. Similarly, when an aqueous formaldehyde solution containing an acid catalyst is applied to the fabric, and then simply heat cured there should be sufficient aqueous formaldehyde present for the reaction. The heat curing takes place at a rather high temperature. In both instances, aqueous formaldehyde is present at a high temperature and is lost from the fabric thereby preventing satisfactory crosslinking and uniform results. It is believed that the formaldehyde steam distills but, by whatever mechanism, the fact remains that the formaldehyde is lost and uniform results are not obtained.

This problem may be obviated by the present invention of a durable press process for cellulosic fiber-containing fabrics which comprises treating a cellulosic fiber-containing fabric with aqueous formaldehyde and a catalyst capable of catalysing the crosslinking reaction between formaldehyde and cellulose, heat curing the treated cellulosic fiber-containing fabric, preferably having a moisture content of more than 20% by weight, under conditions at which formaldehyde reacts with the cellulose in the presence of a catalyst and without the substantial loss of formaldehyde before the reaction of formaldehyde with cellulose to improve the wrinkle resistance of the fabric. The prevention of the substantial loss of formaldehyde before the reaction of formaldehyde with the cellulose may be achieved in several different ways such as by utilizing a binder to prevent the substantial loss of formaldehyde during curing. Alternatively, the heat curing may be effected at a low temperature or over a gradually increasing temperature range which prevents the substantial loss of formaldehyde during curing. A substantial loss of formaldehyde is the loss of that amount of formaldehyde which will reduce the overall extent of the reaction.

Any binder or thickening agent may be used which is effective as a binding agent for the formaldehyde or formaldehyde precursor such as paraformaldehyde. It is essential that an aqueous system be used and that when paraformaldehyde is used it is effectively dispersed throughout the aqueous system. This is necessary so that when the paraformaldehyde is applied to the fabric a uniform distribution on the fabric is obtained. It is well known that paraformaldehyde generates formaldehyde in situ, which in the hydrated form is the crosslinker.

In order to be effective, the thickening or binding agent must not react with the formaldehyde or crosslink with the cellulose. Natural gums may not be used since they contain nitrogen and would also crosslink. However, formaldehyde polymers with polyoxymethylene chains of extremely long length are effective binding agents. Similarly, carboxylated polymers may be used. Such polymers include the carboxy vinyl resins, such as Carbopol 910. Also, alkali soluble acrylic emulsions such as the Acrysol ASE series can be used provided a volatile base such as ammonia is used to sufficiently thicken the padding solution to insure uniform application of the crosslinker. During the course of curing, the ammonia boils off, rendering the solution acid and allowing crosslinking.

A sufficient amount of dispersing or binding agent must be used in the aqueous system to insure the dispersion of paraformaldehyde and the production of a substantially homogeneous system, to insure uniform application. The dispersion should have at least the consistency of light oil.

The aqueous system containing the binder-dispersing agent, dispersed paraformaldehyde therein and an acid catalyst may be padded on the fabric to be treated, preferably to insure a moisture content of more than 20% by weight on the fabric, and then the fabric cured. The presence of the binder prevents the substantial loss of formaldehyde during curing. The use of the binding agent is, in fact, twofold, one to prevent the loss of formaldehyde when aqueous formaldehyde is used, and two, to help suspend the paraformaldehyde in the aqueous solution if paraformaldehyde is used.

The prevention of the substantial loss of formaldehyde before the reaction of formaldehyde with cellulose to improve the wrinkle resistance of the fabric may also be achieved by gradually heating the fabric in the curing stage to prevent the substantial loss of formaldehyde during curing. This may also be accomplished by curing at a low temperature with an active catalyst. The heating techniques are preferred with respect to the binder as they avoid the extra chemical cost which is inherent in the binder system. It is also possible to use any combination of techniques which prevent the substantial loss of formaldehyde during the curing. For example, a low temperature may be used in combination with a thickened aqueous formaldehyde solution. It would also be possible to use a pressurized system wherein the pressure is greater than atmospheric thereby preventing the substantial loss of formaldehyde before the formaldehyde crosslinks with the cellulosic fiber-containing fabric being treated.

The following examples are being presented not as limitations but to illustrate and provide a better understanding of the invention. In order to confirm the fact that formaldehyde was being lost from the conventional processes, experiments were conducted in which the fabric was heated very quickly by very hot air as in the conventional processes as well as in accordance with the present invention.

EXAMPLE 1

A sample of 50/50 polyester cotton sheeting was padded to 100% pickup with an aqueous solution containing 54 grams 37% formaldehyde and 1.2 grams methane sulfonic acid catalyst then placed in a reactor at 100° F and heated to 230° F over a period of about five minutes, then removed and washed and tumble dried.

EXAMPLE 2

A sample of 50/50 polyester cotton sheeting was padded to 100% pickup with an aqueous solution containing 54 grams 37% formaldehyde and 1.2 grams methane sulfonic acid catalyst then placed in a reactor at 100° F and heated to 230° F over a period of about five minutes, then removed and washed and tumble dried.

EXAMPLE 3

A sample of 50/50 polyester cotton sheeting was padded to 100% pickup with an aqueous solution containing 54 grams 37% formaldehyde and 1.2 grams methane sulfonic acid catalyst then placed in a reactor at 100° F and heated to 230° F over a period of about five minutes, then removed and washed and tumble dried.

EXAMPLE 4

A fresh solution as in Example 1 was prepared and the sample was padded to 100% pickup and placed in the reactor at 130° F, and heated to 230° F, then removed and washed and tumble dried.

EXAMPLE 5

A similar piece of fabric as used in Example 1 was padded to 100% pickup with the same solution as in Example 4, then placed in the reactor at 160° F, heated to 230° F, and then washed and tumble dried.

EXAMPLE 6

This example was the same as Example 5 but the fabric was placed in the reactor at 200° F and heated to 230° F then washed and tumble dried.

EXAMPLE 7

This example was the same as Example 5 but the fabric was placed in the reactor at 230° F and maintained for five minutes. The sample was then washed and tumble dried.

All samples in Examples 1 to 7 were in the reactor for the same length of time.

In Examples 1–7 all samples were padded with an aqueous solution containing 54 grams of 37% formaldehyde in 400 ml water and 1.2 grams methane sulfonic acid. This produces 5.0% formaldehyde on the weight of the fabric using the 37% formaldehyde solution obtained commercially.

TABLE 1

| Example No. | Temperature (° F) Start | Finish | Crease Recovery Angle Degrees Warp | Filling | W.+F. |
|---|---|---|---|---|---|
| 1 | 100 | 230 | 150.0 | 152.0 | 302.0 |
| 2 | 100 | 230 | 150.3 | 154.0 | 304.3 |
| 3 | 100 | 230 | 151.3 | 152.7 | 304.0 |
| 4 | 130 | 230 | 149.3 | 149.3 | 298.6 |
| 5 | 160 | 230 | 146.7 | 148.3 | 295.0 |
| 6 | 200 | 230 | 148.3 | 147.3 | 295.6 |
| 7 | 230 | 230 | 146.7 | 146.3 | 292.3 |

It may be seen from Examples 1–3 that gradual heating did not cause substantial loss of formaldehyde and a higher degree of treatment was obtained. Examples 4–7 show clearly what happens when the fabric is heated faster with hotter conditions. The crease recovery angle drops as a function of the heat, the hotter the conditions used, the lower the results.

The effect of the addition of a binder to an aqueous system may be seen from the following examples.

EXAMPLE 8

A 1% solution of POLYOX MSR 1105 resin (which is a polyoxymethylene polymer based on formaldehyde) in water was prepared by adding 4 grams of the dry powder to approximately 250 ml of water with vigorous stirring. To the thickened mass, 20 grams of paraformaldehyde were added and the solution was stirred profusely and allowed to stand for 24 hours. Just prior to treating the fabric, 1.2 grams of methane sulfonic acid catalyst were added, and enough water to make the total solution 400 ml.

A piece of 50/50 polyester cotton sheeting was padded to approximately 100% pickup with the thickened solution, then heated from 100° F to 230° F over 5 minutes, then washed and tumble dried. The results are shown in Table II as are the results for the following examples. All examples have heating times of about 5 minutes.

METHOD OF PREPARATION OF BINDING SOLUTIONS 4 gms of Polyox resin were weighed out and made into a slurry with 16 grams of isopropanol (anhydrous) and the slurry was well mixed. The slurry was then added to 380 gms of water and the mixture was stirred vigorously. To the thickened solution, 20 gms of paraformaldehyde were added and the solution or suspension stirred again and allowed to stand for 24 hours. Prior to treating fabric, 1.2 grams of methane sulfonic acid were added, and after further stirring, the fabrics were padded to 100% pickup.

EXAMPLE 9

A piece of 50/50 polyester sheeting was padded with the above solution and placed in the chamber or oven at 100° F. The chamber was then heated to 245° F over a period of about 5 minutes and the sample was removed, washed and tumble dried. The thickener was POLYOX MSR 1105.

EXAMPLE 10

Another piece of the same fabric was padded to 100% pickup then placed in the chamber at 245° F and maintained at 245° F for 5 minutes. The thickener was POLYOX MSR 1105, the same as in Example 9.

EXAMPLE 11

Another piece of the same fabric was padded with a similar solution but made with POLYOX MSRN 3000 to 100% pickup then heated from 100° F to 245° F over 5 minutes, then washed and tumble dried.

EXAMPLE 12

Another piece of the same fabric was padded with the same solution as used in Example 11 but was placed in the chamber at 245° F and maintained at 245° F for 5 minutes. The sample was then washed and tumble dried.

For Examples 13 and 14 a thickened base solution was prepared as follows: Four grams of POLYOX MSR 1105 were made into a slurry with 16 grams of anhydrous isopropanol then poured into 324.8 grams of water with vigorous stirring. This solution was allowed to stand overnight to fully dissolve all of the POLYOX resin.

EXAMPLE 13

Aqueous formaldehyde 37% (54 grams) were added to the thickened base solution followed by 1.2 grams methane sulfonic acid. The solution was well mixed and used to pad a piece of 50/50 polyester cotton sheeting. The sample was then placed in the oven at 100° F and heated to 230° F over 5 minutes, then removed and washed and tumble dried.

EXAMPLE 14

The same solution was padded on another sample of the same fabric but the sample was placed in the oven at 230° F and maintained at 230° F for 5 minutes. The sample was then washed and tumble dried.

EXAMPLE 15

A sample of the 50/50 polyester cotton sheeting was washed and tumble dried to serve as an untreated control.

TABLE II

| Example No. | $CH_2O$ | Source | Type | Solution Type | Temperature Start | Fin. | CRA Degrees Warp | Fill | W+F |
|---|---|---|---|---|---|---|---|---|---|
| 8 | 5.0 | P | POLYOX | Thick | 100 | 230 | 153 | 153.7 | 306.7 |
| 9 | 5.0 | P | POLYOX | Thick | 100 | 245 | 146.3 | 147.3 | 293.6 |
| 10 | 5.0 | P | POLYOX | Thick | 245 | 245 | 147.0 | 148.3 | 295.3 |
| 11 | 5.0 | P | POLYOX | Thick | 100 | 245 | 147.3 | 146.3 | 293.6 |
| 12 | 5.0 | P | POLYOX | Thick | 245 | 245 | 146.0 | 145.7 | 291.7 |
| 13 | 5.0 | A | POLYOX | Thick | 100 | 230 | 154.7 | 154.3 | 309.0 |
| 14 | 5.0 | A | POLYOX | Thick | 230 | 230 | 152.3 | 153.3 | 305.6 |
| 15 | Control | | — | — | — | — | 122.7 | 120.3 | 243.0 |

Note: Source - P is for paraformaldehyde
A is for aqueous formaldehyde 37%

A comparison of Example 14 of Table II with Example 7 of Table I clearly shows the effect of the thickener on the reduction of reaction by the high heat conditions. Compare a CRA W+F of 305.6 for Example 14 to a CRA for W+F of 292.3 for Example 7.

While the concentration of the binder used in the Examples was about 1%, the exact concentration as well as the exact binder will vary depending upon the reaction system used. These variations would, of course, be obvious to one of ordinary skill in the art. The viscosity of the aqueous system is generally at least about that of light oil. Any compatible effective conventional acid catalyst may be used in the process of the present invention.

As indicated, it is possible to utilize a gradual heating process to prevent the substantial loss of formaldehyde before the reaction of the formaldehyde with the cellulose to improve the wrinkle resistance of the fabric. This is preferable to the use of the binding agent because of a reduction in chemical cost of the process. Moreover, it is also more economical to use an aqueous formaldehyde system than a paraformaldehyde system and the aqueous formaldehyde usually gives better results. It is, of course, possible to effect a low temperature cure at a single temperature but this is not as desirable as a gradual increasing temperature.

The exact temperature range and time during which the curing fabric will be at any given temperature will depend upon the particular catalyst being used, its concentration in solution and the amount of formaldehyde present, as well as the fabric being treated and the desired results. The factors would be readily appreciated by one skilled in the art. Generally, a temperature range of from 100° F to 230° F over a period of five minutes will yield good results. The treated fabric may be introduced into a heating zone and the temperature of the zone gradually increased. If a continuous process is desired, the treated fabric may be passed through zones of increasing temperatures to produce the necessary heating without substantial loss of formaldehyde. The number and temperature difference between zones is also not critical so long as the substantial loss of formaldehyde is prevented.

The effect of gradual heating is readily apparent from the following examples:

EXAMPLE 16

A solution was prepared without thickener by adding 54 grams of aqueous 37% formaldehyde to water along with 1.2 grams methane sulfonic acid and the total solution brought up to 400 ml with water. A piece of 65/35 polyester cotton sheeting was padded to 100% pickup with the solution and placed in the chamber at 100° F and heated to 230° F over 5 minutes. The sample was then removed and washed and tumble dried to give a CRA of W+F of 305.6.

EXAMPLE 17

Another sample of the same fabric was padded with the same solution as used in Example 16 and placed in the oven at 230° F and maintained at this temperature for 5 minutes. The sample was then removed and washed and tumble dried, to give a CRA of W+F of 298.0.

EXAMPLE 18

A piece of 50/50 polyester cotton was padded with 5% aqueous formaldehyde (anhydrous basis) and 3.12% $SO_2$ via sulfurous acid. The sample was heated from 100° F to 230° F over about 5 minutes, then washed and dried. The sample was very brown and very over treated, with a CRA of W-155.7, F-158.3 and W+F-314.0.

EXAMPLE 19

The same procedure as in Example 18 was followed but heated only to 210° F. The color was light cream and the CRA was W-159.3, F-159.3 and W+F-319.0. At the lower temperature degradation was substantially less as indicated by the better color and higher CRA. Degradation was so high in Example 18 that it affected the CRA. As the fibers bend, they break.

EXAMPLE 20

Control Color- white, CRA W-137.0, F-143.7, W+F 280.7.

In view of the simplicity of the present process a wide range of known acid catalysts may be used. It is preferably to use non-gaseous catalysts to avoid the inherent difficulties in handling gases. Such acid catalysts include acid salts, such as ammonium, magnesium, zinc, aluminum and alkaline earth metal chlorides, nitrates, bromides, bifluorides, sulfates, phosphates and fluoroborates. Also included are acids such as sulfamic, phosphoric, adipic, fumaric, and the like acids. An especially effective group of catalysts is sulfuric acid, sulfurous acid (dissolved $SO_2$) methane sulfonic acid and para-toluene sulfonic acid, i.e. active catalyst.

The concentration of the catalyst may vary over a wide range dependent upon the particular type, the fabric to be treated, the temperature of the cure and the like conditions. However, in general the catalyst is incorporated in the fabric, on a dry weight basis in an amount within the range of from 0.1 to about 10%, preferably 0.1 to 6%. For example and as can be seem from the following, as little as 0.3% of methane sulfonic acid was effective. Thus for methane sulfonic acid and para-toluene sulfonic acid as little as 0.1% may be used and for sulfurous and sulfuric acid as little as 0.02% may be used.

In Examples 21–25 65/35 polyester cotton fabric was padded with the appropriate 5% aqueous formaldehyde solutions, (5% on the fabric) to 100% pickup and then heated from 100° F to 210° F over 5 minutes, then washed and tumble dried.

EXAMPLE 21

MgCl 2.0%, $CH_2O$%, 5.0%; W=150.0, F=148.7 and W+F=298.7.

EXAMPLE 22

$NH_4Cl$ 2.0%, $CH_2O$%, 5.0%; W=147.0, F=147.0 and W+F=294.0.

EXAMPLE 23

Oxalic Ac 2.0%, $CH_2O$%, 5.0%; W=145.7, F=147.0 and W+F=292.7.

EXAMPLE 24

Control — — —; W=129.7, F=131.7 and W+F=261.4.

EXAMPLE 25

M.S.A. 0.3%, $CH_2O$%, 5.0%; W=155.7, F=160.3 and W+F=316.0.

Sulfurous acid is also a particularly effective catalyst as can be seen from the following table, Table III, which also illustrates the tremendous range of the catalyst. Table III summarizes the results of the present process on a 50/50 muslin fabric. The fabric was treated with a 37% aqueous formaldehyde solution to give 5% formaldehyde on the fabric and containing the amount of catalyst as indicated. The fabric was heated over a temperature of from 100° F to 280° F for a period of 5 minutes.

TABLE III

| Example No. | Formaldehyde % | Catalyst % | Crease Recovery Angle W. | F. | W&F. |
|---|---|---|---|---|---|
| 26 | 5.0 | 2.0 | 158.7 | 158.3 | 317.0 |
| 27 | 5.0 | 1.0 | 156.0 | 157.3 | 313.3 |
| 28 | 5.0 | 0.5 | 159.0 | 158.3 | 317.3 |
| 29 | 5.0 | 0.4 | 157.0 | 158.3 | 315.3 |
| 30 | 5.0 | 0.3 | 158.0 | 158.7 | 316.7 |
| 31 | 5.0 | 0.2 | 159.0 | 157.7 | 316.7 |
| 32 | 5.0 | 0.15 | 153.0 | 154.0 | 307.0 |
| 33 | 5.0 | 0.125 | 153.0 | 152.7 | 305.7 |
| 34 | 5.0 | 0.100 | 154.3 | 151.7 | 306.0 |
| 35 | 5.0 | 0.050 | 151.0 | 145.7 | 296.7 |
| 36 | 5.0 | 0.040 | 155.3 | 152.0 | 307.3 |
| 37 | 5.0 | 0.030 | 155.7 | 151.3 | 307.0 |
| 38 | 5.0 | 0.020 | 152.3 | 152.7 | 305.0 |
| 39 | 5.0 | 0.010 | 151.0 | 145.3 | 296.3 |
| 40 | 5.0 | 0.005 | 152.3 | 149.3 | 301.6 |
| 41 | 5.0 | 0.002 | 151.7 | 145.7 | 297.4 |
| 42 | — | — | 134.7 | 131.3 | 266.0 |
| 43 | — | — | 135.3 | 129.3 | 264.6 |

Table III clearly indicates the tremendous range of the process. Note that at 0.2% catalyst ($SO_2$) there is a break off point and higher concentrations of the catalyst do not significantly improve the results. However, at as little as 0.002% ($SO_2$) some durable press treatment is obtained.

Using the same technique as described for the Examples of Table III, a 65%/35% polyester cotton shirting fabric was treated with varying amounts of $SO_2$ as sulfurous acid as indicated in Table IV.

TABLE IV

| Example No. | Formaldehyde % | Catalyst $SO_2$ % | Crease Recovery Angle W. | F. | W+F. |
|---|---|---|---|---|---|
| 44 | 5.0 | 1.0 | 153.7 | 154.3 | 308.0 |
| 45 | 5.0 | 0.5 | 151.3 | 156.7 | 308.0 |
| 46 | 5.0 | 0.2 | 152.0 | 151.7 | 303.7 |
| 47 | 5.0 | 0.1 | 151.3 | 153.7 | 305.0 |
| 48 | 5.0 | 0.05 | 144.3 | 142.7 | 287.0 |
| 49 | 5.0 | 0.02 | 136.3 | 134.0 | 270.3 |
| 50 | 5.0 | 0.01 | 129.7 | 130.0 | 259.7 |
| 51 | 5.0 | 0.005 | 138.0 | 130.7 | 268.7 |
| 52 | — | — | 135.7 | 133.0 | 268.7 |
| 53 | — | — | 131.7 | 126.0 | 275.7 |

Table IV shows some dropoff at a catalyst concentration of about 0.1%.

The effective use of formaldehyde in the present process enables the use of smaller quantities of formaldehyde since substantial loss of formaldehyde is prevented. This may be seen from the following results reported in Table V.

In each example reported in the table, each sample of a 65/35 fabric was treated by padding tc a 100% by wet pickup with an aqueous solution containing 0.3% methane sulfonic acid catalyst and varying amounts of aqueous formaldehyde as indicated. All samples were gradually heated from a temperature of 100° F over a five minute period to 230° F.

TABLE V

| Example No. | Formaldehyde (100% Basis) O.W.F. (%) | CRA Warp | Filling | W+F. |
|---|---|---|---|---|
| 54 | 5.0 | 156.3 | 157.3 | 313.6 |
| 55 | 4.0 | 156.7 | 155.7 | 312.4 |
| 56 | 3.0 | 155.7 | 154.0 | 309.7 |
| 57 | 2.0 | 152.3 | 153.3 | 305.6 |
| 58 | 1.0 | 145.0 | 145.7 | 290.7 |

As can be seen, with as little as 1.0 formaldehyde some treatment is obtained. However, it is preferable to use from about 2 to 4% formaldehyde.

It is also possible to heat for longer periods at lower temperatures without gradually increasing the temperature as demonstrated by the following examples summarized in Table VI. The samples of the examples were all padded through the same solution then squeezed to 100% pickup. The solution contained 0.3% methane sulfonic acid, 5% formaldehyde (anhydrous basis) and 0.1% nonionic wetting agent The samples were next placed in a reactor, already heated to a prescribed temperature and maintained at that temperature for 5 or 10 minutes. The time and temperature are indicated in Table VI. All samples were 65/35 polyester cotton industrial shirting.

TABLE VI

| Example No. | $CH_2O$ % | MSA % | Cure Temp (Deg) | Cure Time (Min) | Crease Recovery Angle (deg.) W. | F. | W+F | Filling Strength (Lbs) |
|---|---|---|---|---|---|---|---|---|
| 59 | 5.0 | 0.30 | 130 | 5 | 132.3 | 135.0 | 267.3 | 56 |
| 60 | 5.0 | 0.30 | 130 | 10 | 132.3 | 132.3 | 264.6 | 56 |
| 61 | 5.0 | 0.30 | 150 | 5 | 140.3 | 140.3 | 280.6 | 58 |
| 62 | 5.0 | 0.30 | 150 | 10 | 140.3 | 141.7 | 282.0 | 51 |
| 63 | 5.0 | 0.30 | 170 | 5 | 141.3 | 138.3 | 279.6 | 57 |
| 64 | 5.0 | 0.40 | 170 | 10 | 142.0 | 146.3 | 288.3 | 48 |
| 65 | 5.0 | 0.30 | 190 | 5 | 150.0 | 147.7 | 297.7 | 54 |
| 66 | 5.0 | 0.30 | 190 | 10 | 150.3 | 155.3 | 305.6 | 54 |
| 67 | 5.0 | 0.30 | 200 | 5 | 150.7 | 150.0 | 300.7 | 56 |
| 68 | 5.0 | 0.30 | 200 | 10 | 149.3 | 153.7 | 303.0 | 50 |
| 69 | 5.0 | 0.30 | 210 | 5 | 151.0 | 151.3 | 302.3 | 53 |
| 70 | 5.0 | 0.30 | 210 | 10 | 151.3 | 151.3 | 302.6 | 49 |
| 71 | 5.0 | 0.30 | 220 | 5 | 150.7 | 150.0 | 300.7 | 53 |
| 72 | 5.0 | 0.30 | 220 | 10 | 156.7 | 148.7 | 305.4 | 55 |
| 73 Control | — | — | — | — | 132.0 | 128.7 | 260.7 | 50 |

It is obvious from Table VI that the reaction starts at 150° F over a 5 minute period as a significant amount of treatment has been obtained. This is quite unexpected as one would not have expected this much treatment until a temperature of at least 210° F had been reached. When a temperature of 190° F was used full treatment was obtained which is equal to anything presently commercially available. However, it will be noted that no CRA values of up in the 310° range were obtained as were obtained when the aqueous process is run with the gradual heat.

Another very important consequence of the present process is the better strength retention of the treated fabric at lower reaction temperatures as can be seen from the filling strength given in Table VI.

It is sometimes desirable, depending upon the desired characteristic of the fabric, to add to the fabric a polymeric resinous additive that is capable of forming soft film. For example, such additives may be a latex or fine aqueous dispersion or polyethylene, various alkyl acrylate polymers, acrylonitrile-butadiene copolymers, deacetylated ethylene-vinyl acetate copolymers, polyurethanes and the like.

Such additives are well known to the art and generally commercially available in concentrated aqueous latex form. For use in the process of this invention, such a latex is diluted to provide about 1 to 3% polymer solids in the aqueous catalyst-containing padding bath before the fabric is treated therewith.

As the cellulosic fiber-containing fabric which may be treated by the present process there can be employed various natural or artificial cellulosic fibers and mixtures thereof, such as cotton, linen, hemp, jute, ramie, sisal, rayons, e.g., regenerated cellulose (both viscose and cuprammonium). Other fibers which may be used in blends with one or more of the above-mentioned cellulosic fibers are, for example, polyamides (e.g., nylons), polyesters, acrylics (e.g., polyacrylonitrile), polyolefins, polyvinyl chloride, and polyvinylidene chloride. Such blends preferably include at least 35 to 40% by weight, and most preferably at least 50 to 60% by weight, of cotton or natural cellulose fibers.

The fabric may be a resinated material but preferably it is unresinated; it may be knit, woven, nonwoven, or otherwise constructed. It may be flat, creased, pleated, hemmed, or shaped prior to contact with the formaldehyde. After processing, the formed crease-proof fabric will maintain the desired configuration substantially for the life of the fabric. In addition, the fabric will have an excellent wash appearance even after repeated washings.

This invention is not dependent upon the limited amounts of moisture to control the crosslinking reaction since the crosslinking reaction is most efficient in the most highly swollen state of the cellulose fiber. Relatively high amounts of water may be present which allow more efficient conversion of formaldehyde to the hydrate which is the cross-linker. Thus, optimum results can be obtained with much less formaldehyde at moisture contents above 20% by weight. Lesser amounts of moisture may be used but are less preferred.

During the cross-linking reaction at the curing stage, moisture is given up from the fabric as the cross-linking occurs, resulting in a decrease in the moisture content of the fabric. In fabrics having a moisture content of 20% or less, this tends to lower the effectiveness of the cross-linking reaction requiring higher concentrations of formaldehyde. In a preferred aspect of the present invention, moisture is given up from a high level, that is, greater than 20%, preferably greater than 30%, e.g., from 60–100% or more, and the cross-linking is optimized. Moisture which is so difficult to control, is not a problem in the present invention. Of course, water is not allowed to be present in so much as an excess as to cause the catalyst to migrate on the fabric.

All results reported in the foregoing specification were obtained by the following standard methods:

1. Crease Resistance (Wrinkle Recovery) Recovery Method A.A.T.C.C Test Method 66–1968.

2. Tensile Strength-A.S.T.M.D.-1682-64(Test IC).

Also, in all of the examples a nonionic wetting agent was used as is conventional to the art. The wetting agent was used in an amount of about 0.1% by weight. The wetting agent used in all of the examples was an alkyl aryl polyether alcohol such as Triton X-100.

What is claimed is:

1. A durable press process for cellulosic fiber-containing fabrics which comprises treating the cellulosic fiber-containing fabric with aqueous formaldehyde and a catalyst capable of catalyzing the crosslinking reaction between formaldehyde and cellulose, heat curing said treated fabric by introducing the treated fabric into a heating zone and gradually increasing the temperature of the heating zone thereby gradually increasing the temperature of the heated fabric to prevent the loss of an amount of formaldehyde which will reduce the overall extent of curing.

2. The process of claim 1 wherein the fabric has a moisture content of more than 20% by weight.

3. The process of claim 1 wherein the heat curing consists of gradually increasing the temperature from 100° F to 230° F.

4. The process of claim 1 wherein the temperature increase takes 5 minutes.

5. The process of claim 1 wherein the catalyst is sulfuric acid, sulfurous acid, methane sulfonic acid or paratoluene sulfonic acid.

6. The process of claim 1 wherein the aqueous formaldehyde contains a binding agent which is a formaldehyde polymer with polyoxymethylene chains, carboxylated polymer, or an alkali soluble acrylic emulsion.

7. The process of claim 1 wherein the fabric has a moisture content of more that 30% by weight.

8. The process of claim 1 wherein the fabric is a 65%/35% polyester/cotton fabric.

9. The process of claim 1 wherein the fabric contains from 50 to 60% by weight cotton or natural cellulose fibers.

10. A durable press process for cellulosic fiber-containing fabrics which comprises treating the cellulosic fiber containing fabric with aqueous formaldehyde and a catalyst capable of catalyzing the crosslinking reaction between formaldehyde and cellulose, heat curing said treated fabric by passing said treated fabric through zones of increasing temperatures to produce heat curing by gradually increasing the temperature of the treated fabric to prevent the loss of an amount of formaldehyde which will reduce the overall extent of curing.

11. The process of claim 10, wherein the fabric treated has a moisture content of more than 20% by weight.

12. The process of claim 10 wherein the fabric treated has a moisture content of more than 30% by weight.

13. The process of claim 10 wherein the formaldehyde is generated in situ from paraformaldehyde.

14. The process of claim 10 wherein the catalyst is sulfuric acid, sulfurous acid, methane sulfonic acid or paratoluene sulfonic acid.

15. The process of claim 10 wherein the fabric is a 65%/35% polyester/cotton fabric.

16. The process of claim 10 wherein the fabric contains at least 35% by weight cotton or natural cellulose fibers.

* * * * *